US007802449B1

(12) United States Patent
Levitt

(10) Patent No.: US 7,802,449 B1
(45) Date of Patent: Sep. 28, 2010

(54) CLUSTER MOUNTING MECHANISM

(75) Inventor: Jeffrey Levitt, Huntington, NY (US)

(73) Assignee: Elegant Collection, Mumbai (IN)

( * ) Notice: Subject to any disclaimer, the term of this patent is extended or adjusted under 35 U.S.C. 154(b) by 654 days.

(21) Appl. No.: 11/801,871

(22) Filed: May 14, 2007

(51) Int. Cl.
*A44C 17/02* (2006.01)

(52) U.S. Cl. ..... 63/28

(58) Field of Classification Search ..... None
See application file for complete search history.

(56) References Cited

U.S. PATENT DOCUMENTS 2,774,231 A * 12/1956 Peterson ..... 63/28
5,377,506 A * 1/1995 Tranzer ..... 63/28
6,003,335 A * 12/1999 Gurevich et al. ..... 63/26
7,444,835 B2 * 11/2008 Mehta ..... 63/28
7,461,452 B1 * 12/2008 Kothari ..... 29/896.412
7,546,749 B1 * 6/2009 Biren ..... 63/15
2005/0188722 A1 * 9/2005 Nevatia et al. ..... 63/26

* cited by examiner

*Primary Examiner*—Jack W. Lavinder
(74) *Attorney, Agent, or Firm*—Levisohn Berger LLP

(57) ABSTRACT

A cluster mounting mechanism that utilizes a center anchor comprising a channel to assist in holding stones in place. The channel holds the lower stones in place as the upper stones are set in the mounting. The channels are formed of pairs of opposite recesses located perpendicularly with respect to each other.

9 Claims, 2 Drawing Sheets

CLUSTER MOUNTING MECHANISM

FIELD OF THE INVENTION

The present invention relates generally to the field of jewelry and particularly to a mechanism that enables a cluster of diamonds to be set.

BACKGROUND OF THE INVENTION

Large diamond stones are very highly desirable in the wholesale and retail areas of the jewelry industry. From both perspectives, large diamond stones are very expensive and can be extremely difficult to find. From the manufacturer's perspective, performing work, such as cutting, on large gemstones can be a difficult task. Large gemstones can be difficult to handle in terms of their bulkiness. Furthermore, if stones are damaged during such cutting, the value of the large gemstone diminishes dramatically.

In the past, due to these concerns, the jewelry industry took a different approach. Instead of using only large gemstones, jewelers have tried to imitate the large diamond look. Manufacturers have been using numerous smaller, cheaper gemstones and cluster the small stones together in a manner to resemble the appearance of a large gemstone. As a result of this, manufacturers have sought out cheaper and less labor-intensive solutions.

The prior art provides alternative ways to achieve the large gemstone appearance. The prior art provides a means to set clusters of small stones together to achieve the large gemstone look. Additionally, some cluster settings have larger and smaller stones set at different planes with the upper stones bearing on and holding the lower stones in place. These smaller, individual gemstones are sometimes set with prongs, which is a time consuming process to hold the lower stones in place. When the smaller lower stones merely rest in place when upper stones are being set, the lower stones can slip making the setting process difficult.

Even though the prior art has various methodologies to create the look of a large gemstone by clustering small gemstones set by prongs, there are too many prongs employed, and the clean gemstone look is compromised. Invisible setting having upper stones bearing on lower stones has been one solution, but such a technique is flawed with stones bearing on each other hiding too much stone surface for such supporting functions, and perhaps not being secure enough to prevent the stones from falling out of the settings, in addition to the problem identified above when the stones are being set.

SUMMARY OF THE INVENTION

A cluster mounting is provided which comprises a plurality of cavities arranged in a rectangle in which small diamonds are set at a lower level. Each cavity is shaped to conform to the lower shape of the stones and holds such stones. Prongs are used along the periphery of the structure to hold the outer edges of the upper stones and a novel center anchor or cleat structure is provided to hold or secure the inner edges of the center stones so as to provide a secure setting mechanism.

One advantage of this invention is that the anchor or cleat structure holds the lower stones in place while the upper stones are added and set. The anchor or cleat provides a secure holding of such lower stones during the setting process.

In addition, the center anchor structure provides a mechanism to firmly hold the smaller stones in their respective places so that the smaller stones do not become loose due to time and wear.

While a preferred embodiment is a rectangular mounting the anchor and cleat securing mechanism can be used for any shape mounting and for most any shaped stone.

DETAILED DESCRIPTION OF THE PREFERRED EMBODIMENT OF THE INVENTION AND THE DRAWINGS

Embodiments of the present invention will now be described with reference to the above-identified figures of the Drawings. However, the Drawings and the description herein of the invention are not intended to limit the scope of the invention. It will be understood that various modifications of the present description of the invention are possible without departing from the spirit of the invention. Also, features described herein may be omitted, additional features may be included, and/or features described herein may be combined in a manner different from the specific combinations recited herein without departing from the spirit of the invention.

The cluster mounting will now be described with reference to FIGS. 1-4.

Figure 1:
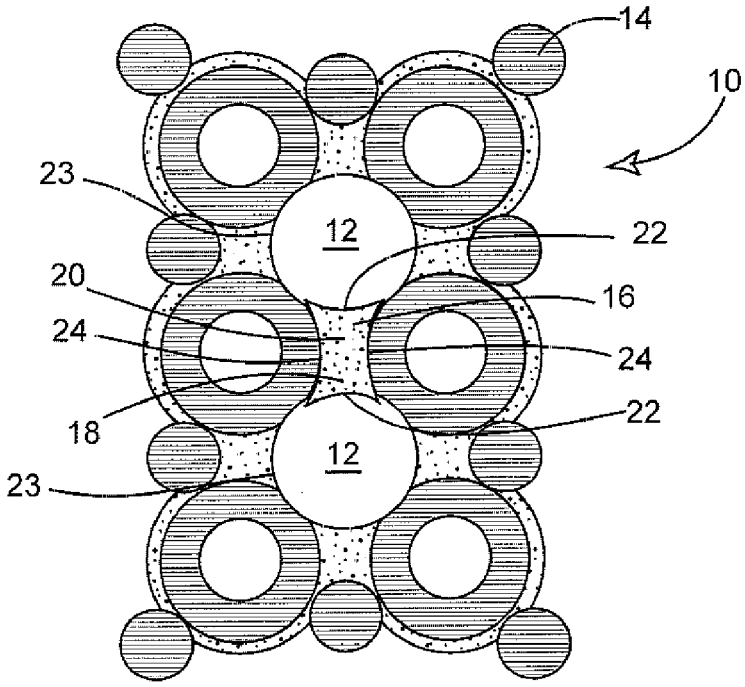
FIG. 1 is a perspective view of the cluster mounting of this invention.

There is shown a rectangular cluster mounting 10 of this invention in FIG. 1 which only two smaller center stones 12 have been set. Prongs 14 are located along the outer periphery of the mounting 10 and a first lower stone 12 is slid under a north-facing cleat 16. Cleat 16 is part of a center anchor structure 20 formed in the center of the mounting 10 (see FIG. 1) in which there are opposite cleats 16 and 18 having a north-south orientation which include north-south and east-west channels or recesses 22 and 24, respectively at 90 degrees to each other. Channels 22 receive and hold inner edges of the girdles 23 of respective smaller stones 12. The cleats 16 and 18 are disposed parallel to the long rectangular dimension of the mounting 10. A plurality of cavities 26 rectangularly arranged is located along the outer periphery of the mounting 10 for larger stones 30. Cavities 26 are at an upper level. Centered within these cavities 26 are smaller, centered cavities 28. Cavities 28 are at a lower level than the level at which cavities 26 exist, and cavities 28 hold stones 12. These smaller center stones 12 are slid into channels 22 and bear against cleat or anchor 16 and held in place while the larger stones are being set on top of the smaller stones.

Figure 2:
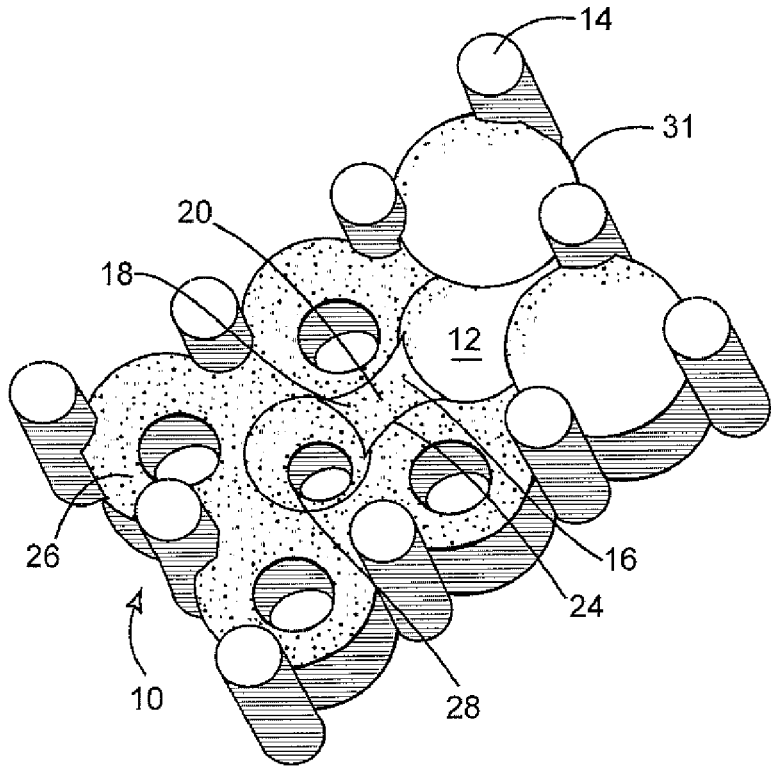
FIG. 2 is a perspective view of the mounting in which only a few gemstones are set to better illustrate the apparatus and method of this invention.

FIG. 2 shows how the larger upper stones 30 are placed in their cavities 26 and bear on lower stones 12. In FIG. 2, the cleats 16, 18 are shown having channels 22 in the northernly-southernly direction and slots 24 disposed in the east-west direction. As is seen in the Figures, the channels have a height sufficient to accommodate both the lower and upper stones.

Figure 3:
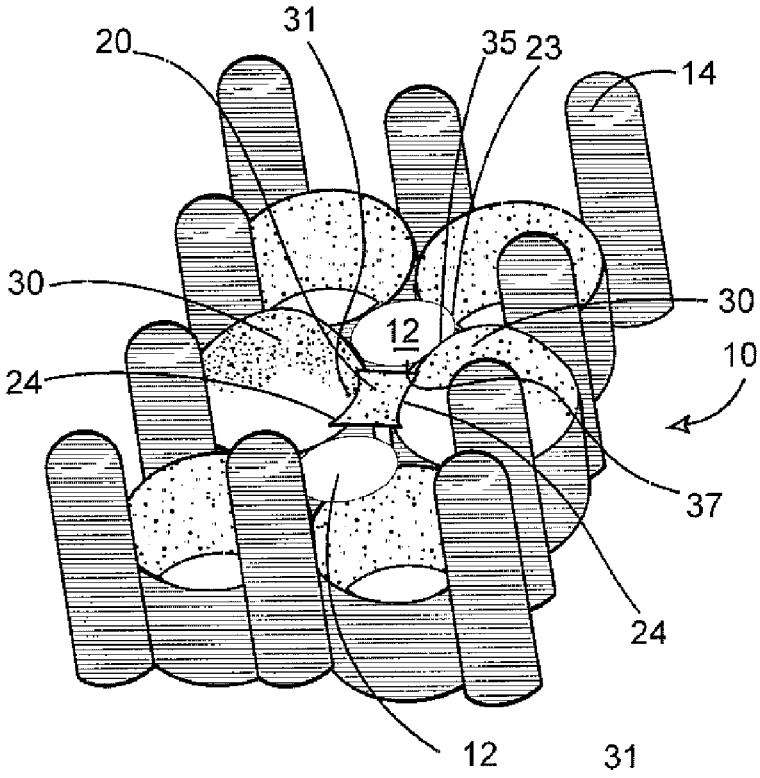
FIG. 3 is a perspective view of the mounting showing the connection of upper center stones in the mounting.

FIG. 3 is a perspective view of the mounting showing the girdle 31 of larger center stones 30 inserted into respective channels 24 that is part of a center anchor structure 20. Channels 22 are at a lower level than channels 24, and the center anchor 20 holds the inner edges or girdle 23 of the lower stones 12 in slots 22 (see FIG. 1). The inner edges or girdle 31 of the upper stones 30 fits into channels 24. The outer edges of larger stones 30 are also set in the mounting 10 by peripherally located prongs 14. When the larger stone 30 is set in the mounting 10, it provides additional support to keep the smaller stones 12 in place in addition to the channels 22 of anchor 20. Indeed the pavilions 35 of stones 30 bear on the bezel 37 of lower stone 12. Each of the upper stones is held in place at three locations along its periphery; at locations 90°, 180° and 270° for the outer upper stones 30 and at locations 0°, 120° and 240° for the center outer stones 30.

Figure 4:
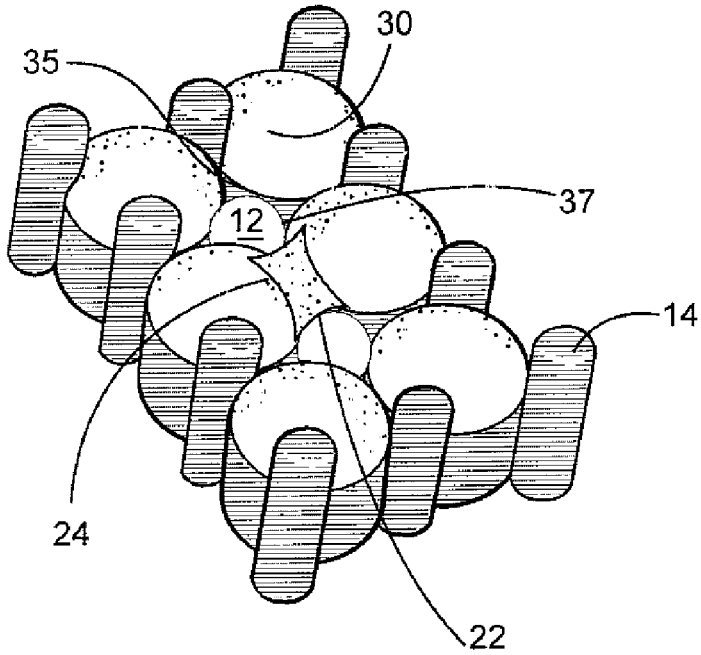
FIG. 4 is a perspective view of the cluster completed.

FIG. 4 is a perspective view showing the completely set cluster showing six larger stones 30 set in two columns of three each with the smaller stones 12 lower than stones 30. The lower stones 12 and center large stones 30 are held in place by their respective cleats 22 and 24. Prongs 16 also hold stones 30 in place.

While the above illustrates the novel cleat structure 16 with a rectangular mounting having pairs of lower stones and two layers of stones, the novel cleat structure will also be used for other mounting shapes, such as oval or marquise, square or princess, cushion or any other variation where a plurality or cluster of stones are mounted together to give the appearance of a larger single stone.

For instance, the lower stones can be set east-west or in both orthogonal directions. The upper stones are shown having the same size while the lower stones are shown also having the same but smaller size. The upper and lower stones may be of graduated size and the structure of the mounting will vary to accommodate different stone sizes, while retaining the center cleat 16 to securely anchor the lower center stones in place.

The center cleat structure may also be used for more than two layers of stones and additional slots to hold the center edges of additional stones in each layer will be provided. The important element is the center cleat 16 securely anchoring said stone which bears against it by capturing the girdle in a respective slot.

Although the present invention has been described in accordance with the embodiments shown, one of ordinary skill in the art will recognize that there could be variations to the embodiments and those variations would be within the spirit and scope of the present invention. Therefore, although the present invention was described in terms of a particular cluster mounting mechanism, one of ordinary skill in the art readily recognizes that any number of parameters can be utilized and their use would be within the spirit and scope of the present invention.

The invention claimed is:

1. A mounting for a cluster of precious stones, said precious stones comprising a top, bezel, girdle, pavilion and culet, said mounting holding said stones in at least two levels, said at least two levels being an upper and a lower level, said mounting comprising a plurality of cavities, each of said cavities configured to receive said pavilions and culets of said precious stones, said cavities located at said upper and lower levels, said mounting holding stones at said lower level and a plurality of stones and said upper level, an anchor located in the central area of said mounting comprising channels located in the periphery of said anchor to receive a portion of the girdle of said stones at said lower and upper levels, said channels having a height sufficient to accommodate said stones at said lower and upper levels, said stones at said lower level being first set in respective cavities and having said portions of said girdle resting in said channel, said stones at said upper level being set in their respective cavities, said portions of said girdles of said stones at said upper level resting in said channel, said stones set at said upper level bearing on said stones set at said lower level, so as to retain said cluster of stones with each of said stones having said portions of said girdles resting and retained in said channels of said anchor.

2. A mounting as set forth in claim 1, wherein said stones set at said lower level are smaller than said stones set at said upper level.

3. A mounting as set forth in claim 2, wherein the pavilions of said stones set at said upper level bear on the bezels of said stones set at said lower level.

4. A mounting as set forth in claim 1, wherein the pavilions of said stones set at said upper level bear on the bezels of said stones set at said lower level.

5. A mounting as set forth in claim 4, wherein said channel of said anchor is formed of pairs of opposite recesses located perpendicularly to each other.

6. A mounting as set forth in claim 1, wherein said precious stones are round stones.

7. A mounting as set forth in claim 1, wherein said precious stones are diamonds.

8. A mounting as set forth in claim 1, wherein said mounting is rectangular, further comprising a plurality of prongs located along the periphery of said mounting, each of said stones set at said upper level being held at three locations.

9. A mounting as set forth in claim 8, wherein said mounting holds six upper and two lower stones.

* * * * *